US005893303A

United States Patent [19]

Harris

[11] Patent Number: 5,893,303

[45] Date of Patent: Apr. 13, 1999

[54] FASTENER HOLDING PLIERS WITH HAND-GRIP OFFSET

[76] Inventor: Virgil Harris, P.O. Box 124, Point Marion, Pa. 15474

[21] Appl. No.: 08/975,751

[22] Filed: Nov. 21, 1997

[51] Int. Cl.[6] ..... B25C 3/00; B25B 7/00; B25B 7/02

[52] U.S. Cl. ..... 81/44; 81/300; 81/415; 81/420

[58] Field of Search ..... 81/44, 487, 177.1, 81/300, 415, 420; 30/110, 111

[56] References Cited

U.S. PATENT DOCUMENTS

| | | | |
|---|---|---|---|
| 938,499 | 11/1909 | Munsill | 81/366 |
| 3,069,686 | 12/1962 | Smith | 72/409.01 |
| 4,079,765 | 3/1978 | Hatayan | 145/46 |
| 4,390,050 | 6/1983 | Whitney | 145/46 |
| 4,461,193 | 7/1984 | Gruber et al. | 81/420 |
| 4,635,510 | 1/1987 | Box | 81/319 |
| 5,293,792 | 3/1994 | Chiang | 81/44 |
| 5,511,453 | 4/1996 | Neumann et al. | 81/362 |
| 5,591,203 | 1/1997 | Fahy | 606/207 |

*Primary Examiner*—Timothy V. Eley
*Assistant Examiner*—Philip J. Hoffmann
*Attorney, Agent, or Firm*—Kenneth P. McKay, Esq.

[57] ABSTRACT

A pliers which allows the user to firmly hold a tack, nail, or screw for application, particularly when in use against a structure. The pliers incorporates a handle offset which allows the user to apply the fastener when working in close quarters with the point of application. The device includes longnose pliers blades with varying diameter of serrations for firmly holding a wide range of fastener sizes and applying them in hard-to-reach spaces.

5 Claims, 3 Drawing Sheets

FASTENER HOLDING PLIERS WITH HAND-GRIP OFFSET

BACKGROUND OF THE INVENTION

1. Field of the Invention

The present invention, a Fastener Holding Pliers With Hand-Grip Offset, is a device which allows the user to firmly hold a tack, nail, or screw for application, particularly when in use against a structure. The handle offset allows the user to apply the fastener when working in close quarters with the point of application. The device includes long-nose pliers blades with varying diameter of serrations for firmly holding a wide range of fastener sizes and applying them in hard-to-reach spaces.

2. Description of the Related Art

The use of pliers is well known in the art of tools, particularly when used for holding objects, and working with the objects in joining or forming operations. Certainly, pliers are known to be used in assisting with the application of fasteners, particularly nuts being applied to bolts. Standard pliers are also adapted for use in holding the fasteners for application ("starting"), for instance, holding a nail by its shaft as the head of the nail is struck by a hammer for imbedment into wood, or holding a small screw by its threaded portion as a screwdriver is used to start the screw into an object.

A variety of tools are known which are designed specifically for certain fasteners and specifically for starting those fasteners into a structure, as described above. The specific designs include tools for starting nails and tools for starting screws. Other pliers have been designed for very specific use on a pre-determined fastener type or fastener size.

There is a particular need for a pliers which may be used for a variety of fasteners, over a wide range of sizes of those fasteners, and for application in hard-to-reach places where significant longitudinal offset and perpendicular offset from the work area is required. Such a device is described by the present invention.

PRIOR ART

U.S. Pat. No. 4,390,050 (Whitney), dated Jun. 28, 1983, shows a tack pliers with a long handle which allows positioning of a nail for application with a hammer.

U.S. Pat. No. 4,635,510 (Box), dated Jan. 13, 1987, shows an elongated pliers having a torsion spring, and having a spaced pair of eyes for holding fasteners.

U.S. Pat. No. 5,511,453 (Neumann, et al), dated Apr. 30, 1996, shows a pliers for mounting purposes, having a specific purpose especially for sliding sleeve tube connection systems.

U.S. Pat. No. 4,079,765 (Hatayan), dated Mar. 21, 1978, shows an implement for holding and guiding pointed fasteners and comprises a pliers portion having a series of varying diameter holes in the pliers blades for application of a wide range of fastener sizes.

SUMMARY OF THE INVENTION

The objective of the present invention is to provide a pliers-like tool for assisting in the starting of fasteners by firmly gripping the fastener.

A secondary objective is to provide a device, as above, but for particular use in hard-to-reach places.

A third objective is to provide a device, as above, which is particularly adaptable for a wide variety of types and sizes of fasteners.

A fourth objective is to provide a device, as above, which is particularly adaptable for use when the user is working in close proximity to the surface in which a fastener is being started into.

The present invention satisfies these objectives, as shall be set forth herein, by teaching a pliers device having a long reach, an offset handle and having a number of varying size diameter gripping serrations in its gripping portion.

DETAILED DESCRIPTION OF THE PREFERRED EMBODIMENT

The invention will now be described in detail in relation to a preferred embodiment and implementation thereof which is exemplary in nature and descriptively specific as disclosed. As is customary, it will be understood that no limitation of the scope of the invention is thereby intended, and that the invention encompasses such alterations and further modifications in the illustrated device, and such further applications of the principles of the invention illustrated herein, as would normally occur to persons skilled in the art to which the invention relates.

Figure 1:
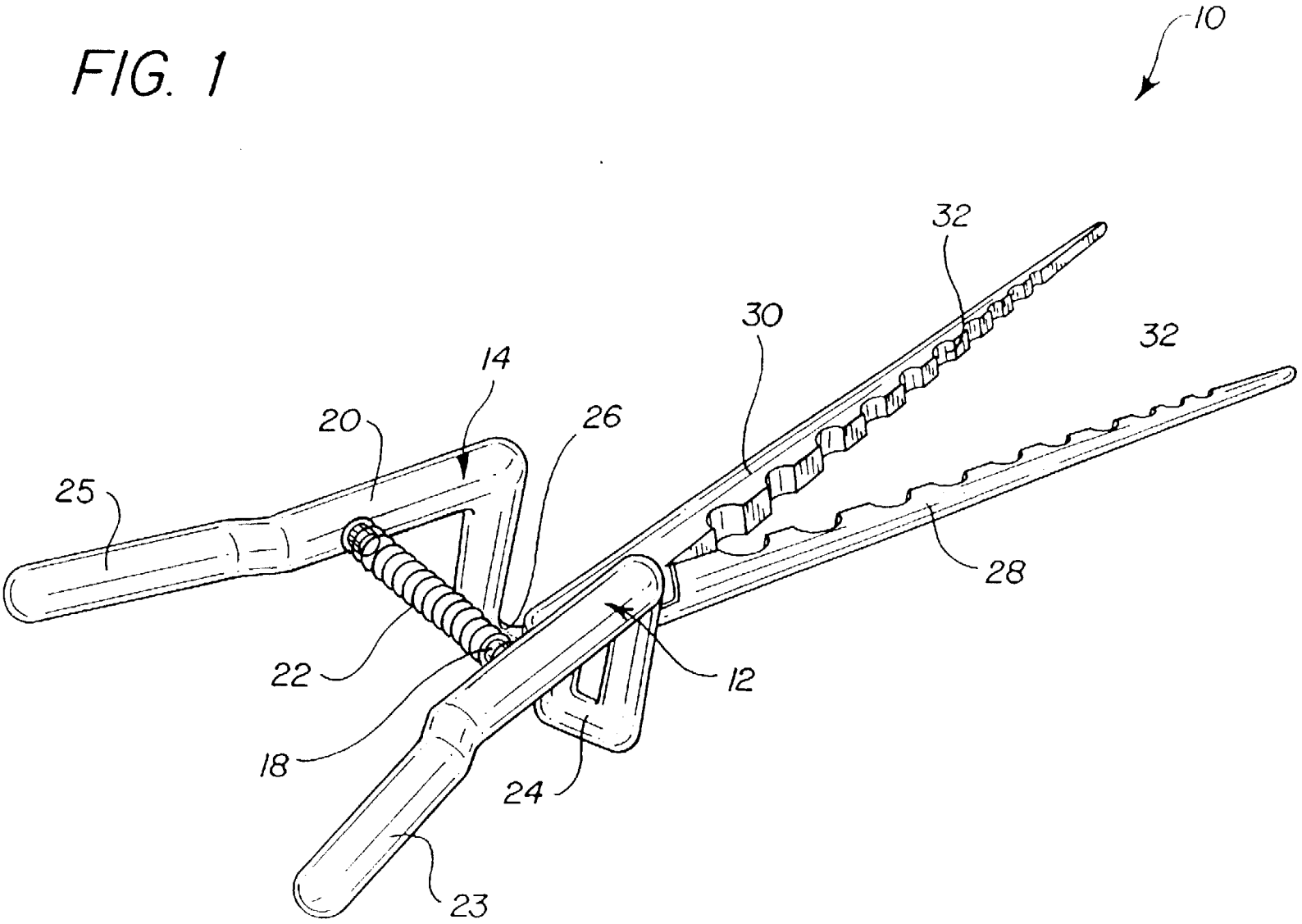
FIG. 1 is a perspective view of the Fastener Holding Pliers With Hand-Grip Offset showing the constituent parts.

FIG. 1 demonstrates the Fastener Holding Pliers With Hand-Grip Offset 10 in the relaxed position and not in use. In this mode, the pliers halves 12 and 14 are separated as the compression spring 22 is relaxed. Pliers halves 12 and 24 are made up of the handles 23 and 25 handle projections 24 and 26 pliers blades 28 and 30, and spring retention pins 18 and 20, respectively. Hinge point 16 FIG. 2) couples pliers halves 12 and 14 together, allowing the two halves to rotate with respect to each other. Pliers blades 28 and 30 have a plurality of fabricated serration halves 32 on each pliers blade, which join together as the pliers blades 28 and 30 are joined on compression of pliers blades 28 and 30 to hold a fastener for application (See FIG. 3). The plurality of serration halves 32 are of varying sizes along the length of pliers blades 28 and 30 to accommodate a wide range of fastener diameters. The means of function and operation become apparent upon observing the device in this relaxed position.

Figure 2:
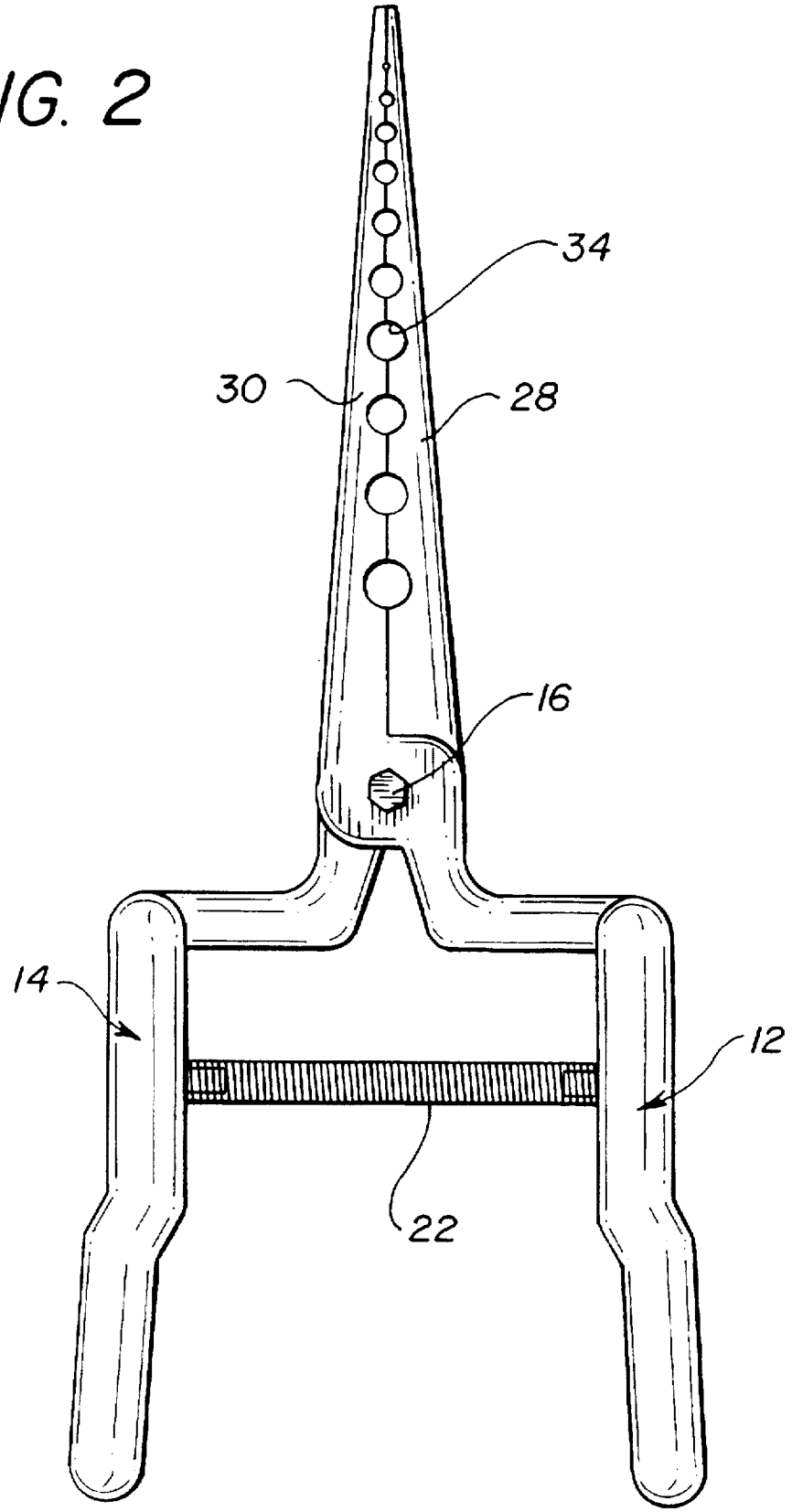
FIG. 2 is a view of the Fastener Holding Pliers With Hand-Grip Offset showing the device with the compression spring compressed such that the pliers tines are seated together.

FIG. 2. shows the device in the compressed position with pliers blades 20 and 30 seated together. In this position, a plurality of holding rings 34 are formed by joining of the serration halves (FIG. 1, 32) as the pliers halves 12 and 14 rotate about hinge point 16. In the compressed mode, compression spring 22 is compressed by the user having squeezed handles 12 and 14 to operate the device.

Figure 3:
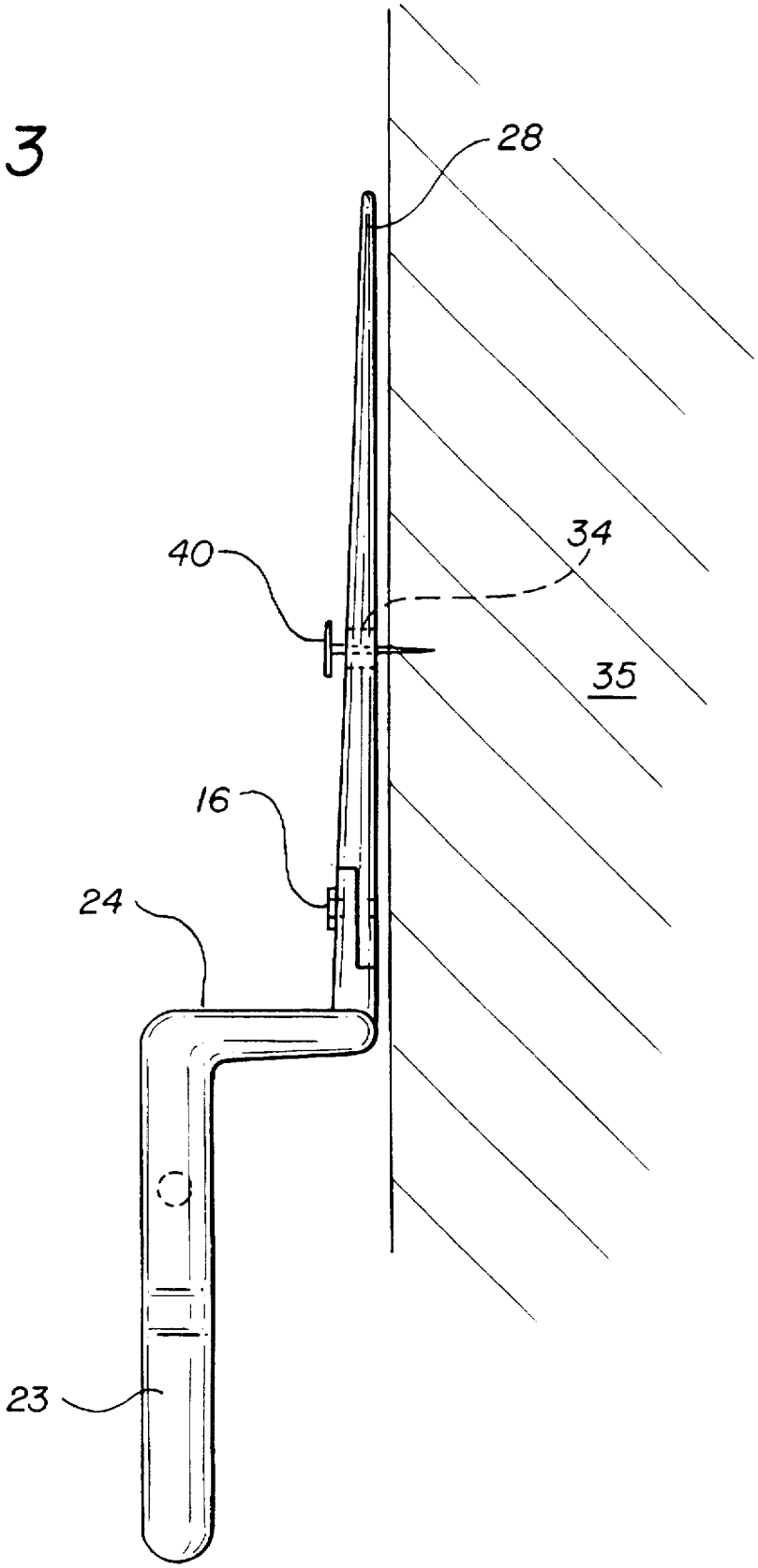
FIG. 3 is a view of the Fastener Holding Pliers With Hand-Grip Offset from the side view showing the pliers tines seated together and holding a fastener in position for application to a structure.

FIG. 3 shows the Fastener Holding Pliers With Hand-Grip Offset 10 in the side view, holding a fastener 40 for application. In the view shown, the pliers blades 28 and 30 are seated together as in FIG. 2. Offset 24 adjoining handle 23 can be seen. The means of operation of hinge point 16 and the respective, overlapping positions of pliers blades 28 and 30 are evident. In this mode of operation, holding ring 34 accommodates fastener 40 as the user situates it for application to structure 35.

The preferred embodiment incorporates into the present invention the complete range of sizes of fasteners, from large to small, by means of the varying diameter of holding ring 34 which can be fabricated into pliers blades 28 and 30.

The Fastener Holding Pliers With Hand-Grip Offset may be made from a variety of materials, depending on its intended use. Metals and hard plastics alike will provide adequate service under most circumstances.

I claim:

1. A Fastener Holding Pliers for starting fasteners into a structure, comprising:

(a) two pliers halves, each having an inner side and an outer side, and each comprising:

(i) a handle having a retention pin on its inner side;

(ii) an L-shaped handle projection, having a short leg and a long leg, abutting said handle whereby said short leg is parallel with said retention pin and said long leg is perpendicularly disposed to said handle, whereby said handle has an offset of the length of said long leg; and, (iii) a long pliers blade having a length and being integral with, and perpendicularly disposed to, said short leg, and having a pivot hole at the point of joining said pliers blade to said handle projection, and having on its inner side along its length a plurality of semi-circular serrations of varying sizes;

(b) a means for pinning and joining said plier halves disposed within said pivot hole of each of said pliers halves thereby aligning said pliers halves such that said semi-circular serrations on said pliers halves are opposing and form circles when said blades are mated; and, (c) a compression spring having two ends, disposed on said handles by mating said retention pin to said respective end of said compression spring, whereby said pliers is operated by compressing said pliers halves toward each other, thereby gripping said fastener within said circle and whereby said handles are offset from said structure by said long leg.

2. A Fastener Holding Pliers for starting fasteners into a structure, as claimed in claim 1, further comprising pliers halves made of metal.

3. A Fastener Holding Pliers for starting fasteners into a structure, as claimed in claim 1, further comprising pliers halves made of hard plastic.

4. A Fastener Holding Pliers for starting fasteners into a structure, as claimed in claim 1, further comprising a nut and bolt as said means for pinning and joining said pliers halves.

5. A Fastener Holding Pliers for starting fasteners into a structure, as claimed in claim 1, further comprising a rivet as said means for pinning and joining said pliers halves.

* * * * *